US006244092B1

(12) United States Patent
Grobbenhaar

(10) Patent No.: US 6,244,092 B1
(45) Date of Patent: Jun. 12, 2001

(54) BENDING MANDREL

(75) Inventor: Hermanus G. Grobbenhaar, Herkenbosch (NL)

(73) Assignee: Grand Prix Silencers B.V., Roermond (NL)

( * ) Notice: Subject to any disclaimer, the term of this patent is extended or adjusted under 35 U.S.C. 154(b) by 0 days.

(21) Appl. No.: 09/308,048

(22) PCT Filed: Nov. 20, 1997

(86) PCT No.: PCT/NL97/00633

§ 371 Date: Jul. 14, 1999

§ 102(e) Date: Jul. 14, 1999

(87) PCT Pub. No.: WO98/22237

PCT Pub. Date: May 28, 1998

(30) Foreign Application Priority Data

Nov. 21, 1996 (NL) ..... 1004579

(51) Int. Cl.[7] ..... B21D 9/03
(52) U.S. Cl. ..... 72/466.2; 72/466
(58) Field of Search ..... 72/150, 369, 466, 72/466.2

(56) References Cited

U.S. PATENT DOCUMENTS

| | | | | |
|---|---|---|---|---|
| 2,825,386 | | 3/1958 | Fuchs, Jr. . | |
| 2,962,077 | * | 11/1960 | Condiff | 72/150 |
| 4,378,689 | * | 4/1983 | Molz | 72/466 |
| 4,671,096 | | 6/1987 | Crosby, Jr. . | |

FOREIGN PATENT DOCUMENTS

| | | | | |
|---|---|---|---|---|
| 3000170 | | 7/1981 | (DE) . | |
| 2097854 | | 11/1982 | (GB) . | |
| 6-170449 | | 6/1994 | (JP) . | |
| 6-234022 | * | 8/1994 | (JP) | 72/150 |
| 585898 | * | 12/1977 | (RU) | 72/466 |

* cited by examiner

*Primary Examiner*—Lowell A. Larson
(74) *Attorney, Agent, or Firm*—Banner & Witcoff Ltd.

(57) ABSTRACT

A bending device for bending tubes, especially composite tubes. The bending device comprises at least two bending mandrels that each include a main part movable at most in the axial direction of the tubes. Each bending mandrel also includes a string of elements that are connected to the main part for pivoting in at least two mutually perpendicular planes.

14 Claims, 3 Drawing Sheets

BENDING MANDREL

The present invention relates to a bending device for bending composite tubes, comprising at least two bending mandrels, wherein;

each of said mandrels is arranged to enter one of the channels of the composite tube, each of said mandrels comprises a main body and a string of elements connected to said main body, and each of the elements of said string is connected to the preceding element, the main body respectively for pivoting in two mutually perpendicular planes relative to the preceding element, the main body respectively.

BACKGROUND OF THE INVENTION

Such a bending device is known from the Patent Abstract of Japan No. 06170449.

This known bending device is used for bending composite pipes, wherein the presence of the bending mandrels in both channels of the pipe prevents the outer wall of the respective channel for bending from being distorted inward during the bending. The presence of the bending mandrel prevents the outer wall of the channel being subjected to bending from displacing inward.

On the inside the effect is the reverse; the material is buckled so that it tends to displace inward as a result of the excess of material.

These problems are obviated by the use of a bending mandrel, in particular a pivotable bending mandrel.

The bending mandrel known from JP 06110449 comprises cylindrial elements. The axes of the elements extend perpendicular to the bending radius and to the axial direction of the pipe. This implies that only on discrete: points the pipe walls are supported during bending, so that the pipe walls will be buckled.

SUMMARY OF THE INVENTION

The aim of the invention is to avoid this problem.

The aim is reached in that the elements each have a substantial cylindrical shape of which the axis is substantially parallel to the axes of the channel. Additionally the axial length of each of said elements is longer than the maximal distance between adjacent elements when the pivoting angle between adjacent elements is maximal.

The first characterizing feature provides a better support for the pipe walls over longer distances than known from said prior art. It is however noted that this feature is known per se from DE-A-30 00 170. This concerns, however, a bending device fit for bending a singel channel pipe.

The second characterizing feature provides in mutual support of the elements in different channels, so that each of the elements in the outer channel is supported by at least one of the elements in the inner channel, so that distorsion of the inner walls between the channels is avoided.

DETAILED DESCRIPTION OF THE INVENTION

Figure 1:
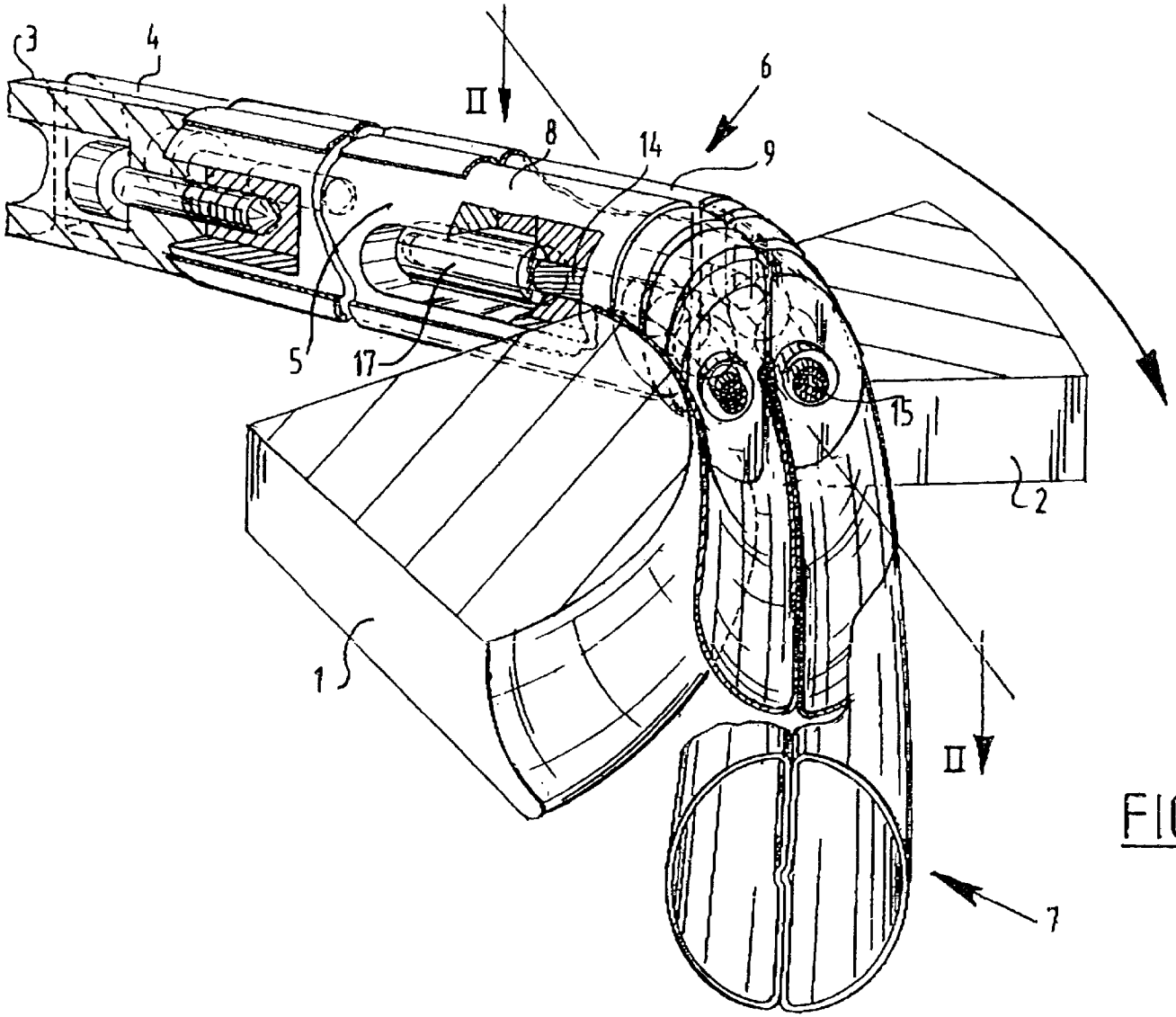
FIG. 1 shows a partly broken away, schematic perspective view of a bending machine provided with a bending mandrel according to the present invention.

Shown schematically in FIG. 1 is a bending machine in the form of a bending mould 1, only the lower half of which its shown, and a pressure piece 2, of which likewise only the lower half is shown. In the present case the bending machine further comprises two rods 3,4 which on their severed ends (not shown) are connected to the bending machine and which are connected on their shown ends to two bending mandrels 5,6 according to the present invention.

The embodiment shown in this drawing is suitable for bending a composite tube with a DD configuration. Such a tube finds application for instance as exhaust for motor vehicles, wherein the ducts connected to the emission ports of different cylinders must be separated over the greatest possible distance to prevent feedback of exhaust gases.

Figure 2:
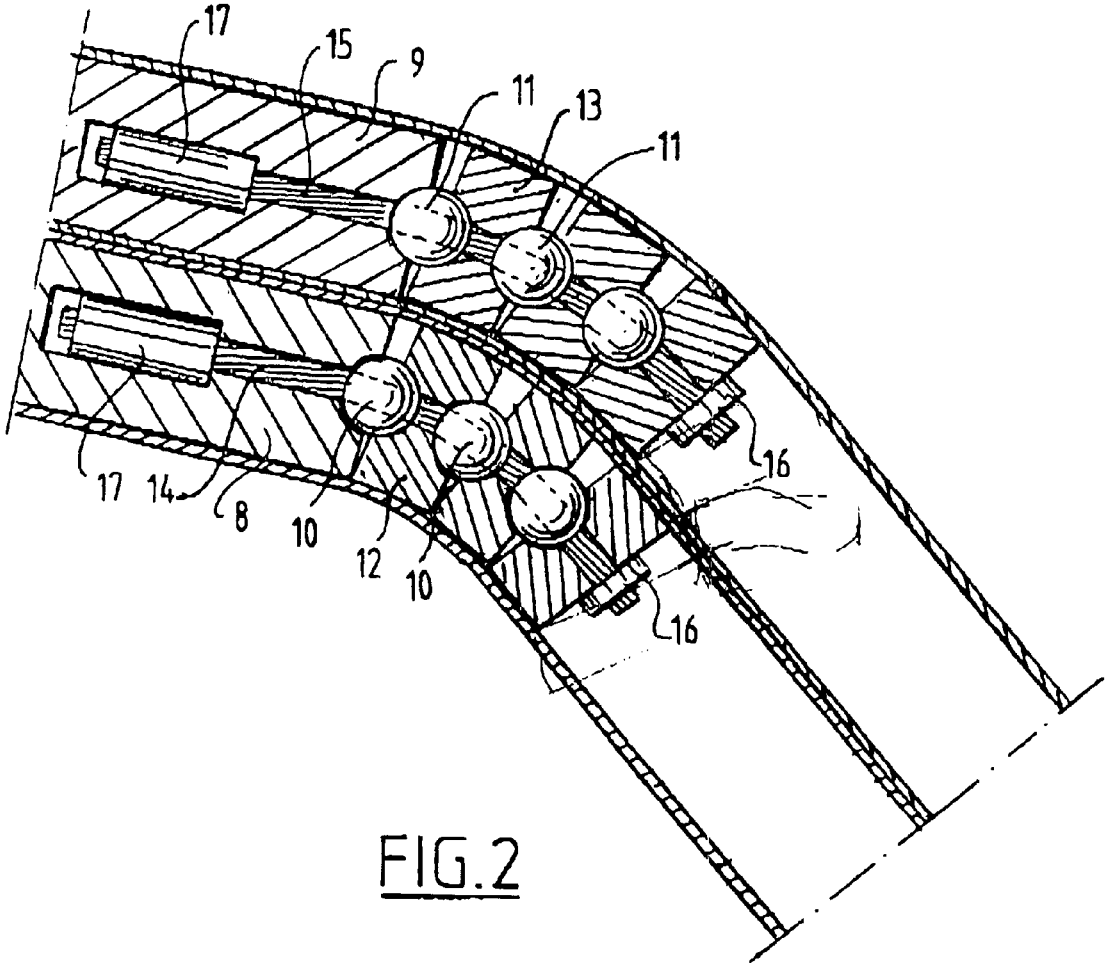
FIG. 2 shows a section along the arrow II in FIG. 1.

As also shown in FIG. 2, each of the bending mandrels 5,6 is formed by a main body 8,9 respectively which is connected by way of balls 10,11 respectively to loose elements 12,13 respectively. The loose elements 12 and 13 are also mutually connected by balls 10 and 11, respectively. Due to the presence of the balls it is possible for the elements 12 to pivot in two directions relative to each other and relative to main part 8. The same applies for elements 13 relative to main part 9.

It will be apparent that it is possible to replace the balls 10 by bodies fixedly mounted on elements 12 or on main body 8. It is important herein that the elements are separated mutually and from the main body by surfaces enabling rotation in two directions, thus preferably spherical surfaces; it will be apparent that other constructions are also possible, for instance hinges with two different rotation shafts.

Since the balls cannot absorb tensile forces, separate measures must be taken for this purpose.

In the embodiment shown in FIGS. 1 and 2 these measures consist of arranging cables 14,15 which are provided on one end with a collar 16 and which at the other end run out into a compression body 17 received on main part 8,9 respectively.

In the embodiment shown in FIGS. 1 and 2 there is only one cable 14,15 extending through each of the elements 12,13 respectively and each of the balls 10,11 respectively.

Figure 3:
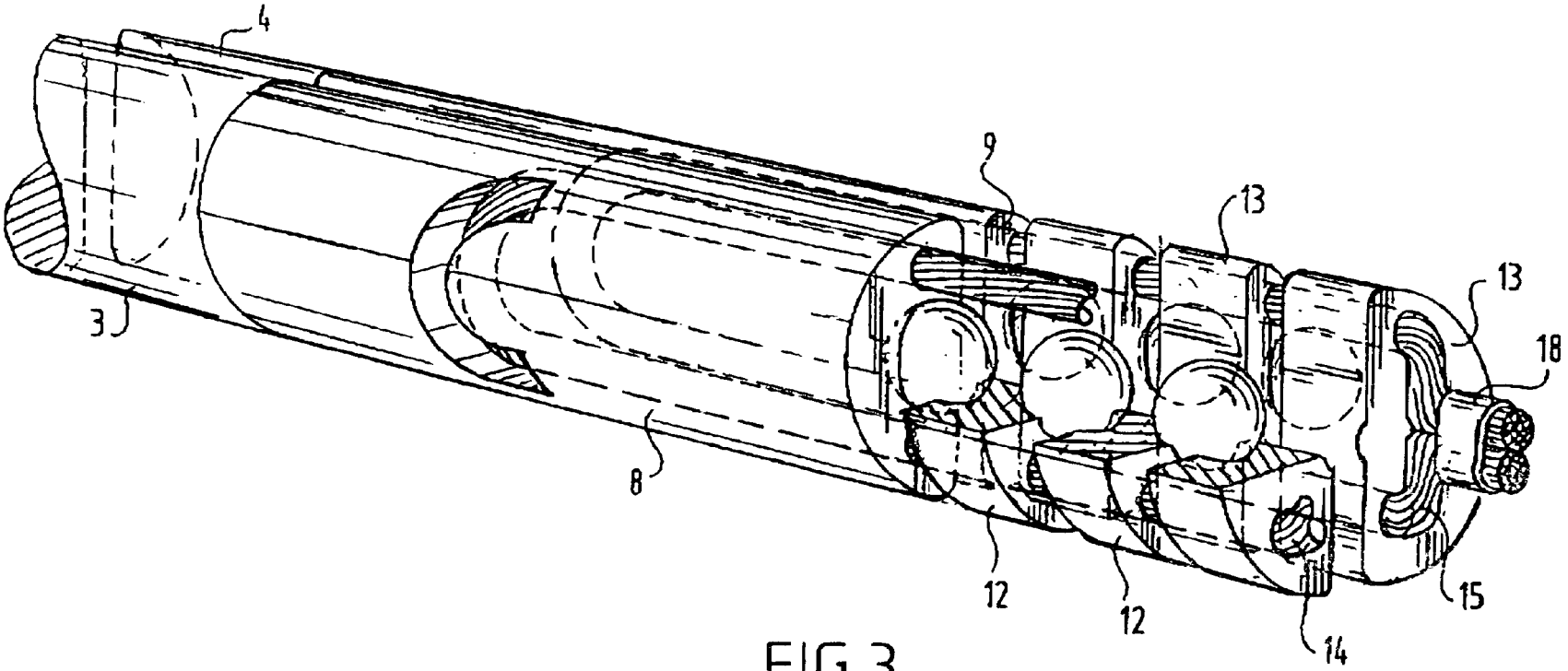
FIG. 3 shows a partly broken away perspective view of a second embodiment of a bending mandrel according to the invention.

It is however also possible to make use of an embodiment as shown in FIG. 3. In this embodiment, the cable is placed in a loop and thus extends twice through each of the elements 12 or elements 13. Both outer ends are connected on one side of the loop by means of a collar 18.

What is claimed is:

1. Bending device for bending composite tubes, comprising at least two bending mandrels, wherein:

each of said mandrels is arranged to enter one of a plurality of channels of the composite tube, each of said mandrels comprises a main body and a string of individual solid elements connected to said main body for supporting a respective one of the tubes, each of the elements of each said string is connected to either a preceding element along its respective string or its respective main body such that each of said elements is pivotable in two mutually perpendicular planes relative to the preceding element or the main body to which it is connected, and wherein the elements each have at least a partially cylindrical shape and an axis that extends substantially parallel to longitudinal axes of the channels, and the axial length of each of said elements is longer than the maximal distance between adjacent elements when a pivoting angle between adjacent elements is maximal.

2. Bending device as claimed in claim 1, wherein a first of said elements of each said string is separated from its respective main body and from a second one of said elements by a pair of at least partially spherical bodies, and wherein said second one of said element is separated from a third one of said elements by another one of the at least partially spherical bodies.

3. Bending device as claimed in claim 2, wherein the elements of each mandrel are connected mutually to each other and to their respective main body by an elongate, flexible body.

4. The bending device of claim 3, wherein the flexible body is a steel cable.

5. Bending device as claimed in claim 2, wherein one of the pair of at least partially spherical bodies is fixedly connected to its respective adjacent main body and the other of said pair of at least partially spherical bodies is connected to the second one of the elements.

6. Bending device as claimed in claim 5, wherein the elements of each mandrel are connected mutually to each other and to their respective main body by an elongate, flexible body.

7. The bending device of claim 6, wherein the flexible body is a steel cable.

8. Bending device as claimed in claim 1 wherein the elements of each mandrel are connected mutually to each other and to their respective main body by an elongate, flexible body.

9. Bending device as claimed in claim 8, wherein each elongate, flexible body extends through all elements and the main body of one of the bending mandrels.

10. Bending device as claimed in claim 9, wherein each flexible body extends through the spherical bodies of one of the bending mandrels.

11. Bending device as claimed in claim 8, wherein each flexible body extends through the spherical bodies of one of the bending mandrels.

12. Bending device as claimed in claim 11, wherein each flexible body extends adjacently of the spherical bodies of one of the mandrels.

13. Bending device as claimed in claim 12, wherein each flexible body has the configuration of a loop and extends on either side of the spherical bodies of one of the mandrels.

14. The bending device of claim 8, wherein the flexible body is a steel cable.

* * * * *